US008517869B2

(12) United States Patent
Steidle

(10) Patent No.: US 8,517,869 B2
(45) Date of Patent: Aug. 27, 2013

(54) BLADDER FOR A BALL

(75) Inventor: Volker Peter Steidle, Fuzhou (CN)

(73) Assignee: adidas International Marketing B.V., Amsterdam (NL)

( * ) Notice: Subject to any disclaimer, the term of this patent is extended or adjusted under 35 U.S.C. 154(b) by 575 days.

(21) Appl. No.: 12/621,177

(22) Filed: Nov. 18, 2009

(65) Prior Publication Data

US 2010/0130315 A1 May 27, 2010

(30) Foreign Application Priority Data

Nov. 25, 2008 (DE) ..... 10 2008 058 943

(51) Int. Cl.
*A63B 41/02* (2006.01)

(52) U.S. Cl.
USPC ..... 473/570

(58) Field of Classification Search
USPC ..... 473/570, 571, 599, 610, 611
See application file for complete search history.

(56) References Cited

U.S. PATENT DOCUMENTS

| | | | | |
|---|---|---|---|---|
| 4,577,865 | A * | 3/1986 | Shishido | 473/570 |
| 4,595,200 | A * | 6/1986 | Shishido | 473/570 |
| 5,228,686 | A * | 7/1993 | Maleyko | 473/570 |
| 5,639,076 | A | 6/1997 | Cmiel et al. | |
| 5,755,634 | A * | 5/1998 | Huang | 473/570 |
| 5,779,575 | A * | 7/1998 | Hsieh | 473/570 |
| 5,883,569 | A | 3/1999 | Kolefas | |
| 5,888,156 | A * | 3/1999 | Cmiel et al. | 473/570 |
| 6,251,035 | B1 * | 6/2001 | Fa | 473/570 |
| 7,179,181 | B2 * | 2/2007 | Ko | 473/570 |
| 7,654,922 | B2 * | 2/2010 | Vassilev et al. | 473/593 |
| 7,740,551 | B2 * | 6/2010 | Nurnberg et al. | 473/570 |
| 2003/0224885 | A1 * | 12/2003 | Leal et al. | 473/570 |
| 2004/0020420 | A1 * | 2/2004 | Evans et al. | 116/34 R |
| 2004/0162170 | A1 | 8/2004 | Ng | |
| 2006/0135297 | A1 * | 6/2006 | Cruciani | 473/570 |
| 2007/0021244 | A1 * | 1/2007 | Ko | 473/570 |
| 2007/0281811 | A1 * | 12/2007 | Wang | 473/570 |
| 2008/0274844 | A1 * | 11/2008 | Ward | 473/570 |
| 2010/0069181 | A1 * | 3/2010 | Lin | 473/570 |
| 2010/0130314 | A1 * | 5/2010 | Von Der Gruen et al. | 473/570 |

FOREIGN PATENT DOCUMENTS

| | | |
|---|---|---|
| DE | 103 50 300 A1 | 6/2005 |
| DE | 10 2007 013 025 | 7/2008 |
| DE | 10 2007 013 025 A1 | 7/2008 |
| DE | 10350300 | 7/2008 |
| EP | 1 637 192 | 9/2005 |
| EP | 1 637 192 A1 | 3/2006 |
| FR | 2 667 510 | 9/1990 |
| WO | WO 99/59684 | 11/1999 |

* cited by examiner

*Primary Examiner* — Steven Wong
(74) *Attorney, Agent, or Firm* — Sterne, Kessler, Goldstein & Fox P.L.L.C.

(57) ABSTRACT

A bladder for an inflatable ball, in particular a soccer ball, has electrical wiring wherein the wiring is at least partially arranged along a bladder wall to interconnect two electrical or electronic devices.

22 Claims, 3 Drawing Sheets

BLADDER FOR A BALL

BACKGROUND OF THE INVENTION

1. Field of the Invention

The present invention relates to a bladder for an inflatable ball with electrical wiring.

2. Background Art

Over the last years the advance of microelectronics has made it possible to provide balls, such as soccer balls, with electrical and/or electronic components. For example, U.S. Pub. No. 2004/0162170 A1, EP 1 637 192 A1, DE 103 50 300 A1, and DE 10 2007 013 025 A1 disclose the arrangement of different sensors, receivers, transmitters or speakers within the bladder of a ball.

A balanced arrangement of several electronic or electrical components, which does not negatively affect the playing properties of the ball, requires either a common positioning in the centre of the bladder or a separate but essentially symmetric distribution of the components so that the ball has no substantial un-balanced mass. If separate components have to be electrically connected, for example, if a small accumulator supplies power to an electronic device, the components must be electrically connected by means of a wire or the like. DE 103 50 300 A1 discloses a centered arrangement of a charging cable between two bladder chambers. If there is sufficient air pressure in the bladder chambers, the cable and the connected electronic component are fixed in the center of the bladder by adjacent walls of the two bladder chambers. In the above-mentioned U.S. Pub. No. 2004/0162170 A1, the electrical cable also extends centrally between two oppositely arranged components through the interior of the bladder and therefore interconnects the two components using a direct path.

The inventor of the present invention understands that the known arrangements may provide a balanced ball construction. However, they are not suitable to withstand the dynamic requirements of a ball, as they occur in particular for soccer balls. In case of a sharp shot, for example for a penalty kick, a soccer ball is subject to considerable forces, which may lead to the ball deforming to a banana-like shape. The wirings inside a bladder known from the prior art cannot withstand such forces so that the cable, its contacts or the connected component are damaged. This applies in particular to freely extending wires inside the bladder but also to the arrangement of wires between two internal bladder walls, in particular if there is an insufficient air pressure in the two bladder chambers so that the cable is not sufficiently fixed.

The present invention is therefore based on the problem to provide a bladder for an inflatable ball having an electrical wiring which is capable of withstanding these loads more efficiently than the arrangements known in the prior art and therefore provides a more reliable function of the connected electrical and/or electronic components.

BRIEF SUMMARY OF THE INVENTION

The present invention solves this problem by providing a bladder for an inflatable ball, in particular a soccer ball, having a form substantially corresponding the form of a ball and electrical wiring, wherein the wiring is at least partially arranged along a bladder wall.

The invention therefore no longer follows the firm belief in the above explained prior art that the wiring has to extend centrally through the interior of the bladder. As a result of the arrangement along a bladder wall, for example the outer bladder wall, which contacts either directly or is separated by a carcass from the outer shell of the ball, the wiring is two-dimensionally anchored and therefore, in contrast to the prior art, mechanically stabilized.

The wiring may be arranged on an inner side of a bladder wall. However, it is also conceivable to arrange the wiring on an outside of the bladder wall or to integrate it into the bladder wall, for example during the manufacture of the bladder material.

In some embodiments, the wiring is at least partially arranged inside a tunnel which may be at least partially formed by the bladder wall. This embodiment may be particularly advantageous to avoid damage to the wires when the bladder undergoes great deformations.

The tunnel may include a plurality of openings towards the interior of the bladder to assure an equalization of the pressure between the interior of the tunnel and the interior of the bladder and to avoid mechanical loads arising as a result of different pressures and when the ball undergoes deformations. Furthermore, two of these openings can be used for the insertion of the wiring.

In one embodiment, at least a part of the wiring along the bladder wall includes a sequence of substantially straight sections interconnected by curved sections. The arrangement of the wiring therefore may not correspond to a geodesic line between the components to be connected, i.e. the shortest interconnection along the outer bladder wall, but on the contrary, may be an intentionally curved course. It has been found that this may be particularly advantageous for the stability of the wiring when the bladder is subjected to strong deformations. Excessive pulling loads are therefore avoided even under strong deformations of the ball or in case of an insufficient pressure inside the bladder.

In one embodiment, the described wiring may include two parts which may be arranged on substantially opposite segments of the bladder wall. The arrangement of the wiring along the outer bladder wall creates an imbalance, which can be largely compensated for by a symmetric arrangement on opposite segments of the bladder.

In the explained embodiments, the wiring may interconnect a first electrical/electronic component with a second electrical/electronic component, for example a pressure sensor for measuring the pressure within the bladder and a display device which can be integrated into the valve of the bladder. However, other fields of use for the described wiring are also conceivable, for example use as an antenna configuration for electromagnetic receivers and/or transmitters of a ball or for the connection of an electromagnetic coil with an energy storage device. Basically, the component to be connected by the wiring can be attached inside or outside of the bladder of the corresponding ball.

According to a further aspect, the present invention relates to a ball, in particular a soccer ball having at least an electrical and/or at least an electronic component. The ball may include a bladder according to the above-described embodiments and therefore its electrical components have a substantially higher lifetime than the designs of the above described prior art.

BRIEF DESCRIPTION OF THE DRAWINGS/FIGURES

Aspects of the present invention are further explained with reference to the accompanying figures. These figures show:

DETAILED DESCRIPTION OF THE INVENTION

In the following, embodiments of the invention are further explained with reference to the example of a bladder for a soccer ball. However, it is to be understood that the present invention is not limited for use in a soccer ball. Other balls with an inflatable bladder, such as handballs, basketballs, volleyballs, rugby balls, balls for American football etc., may also be provided with a wiring as described below. However, the present invention may provide particularly significant advantages for use in a soccer ball, since a soccer ball is subject to particularly great deformations during a soccer game, which is why the wirings of the bladder known from the prior art often fail.

Figure 1:
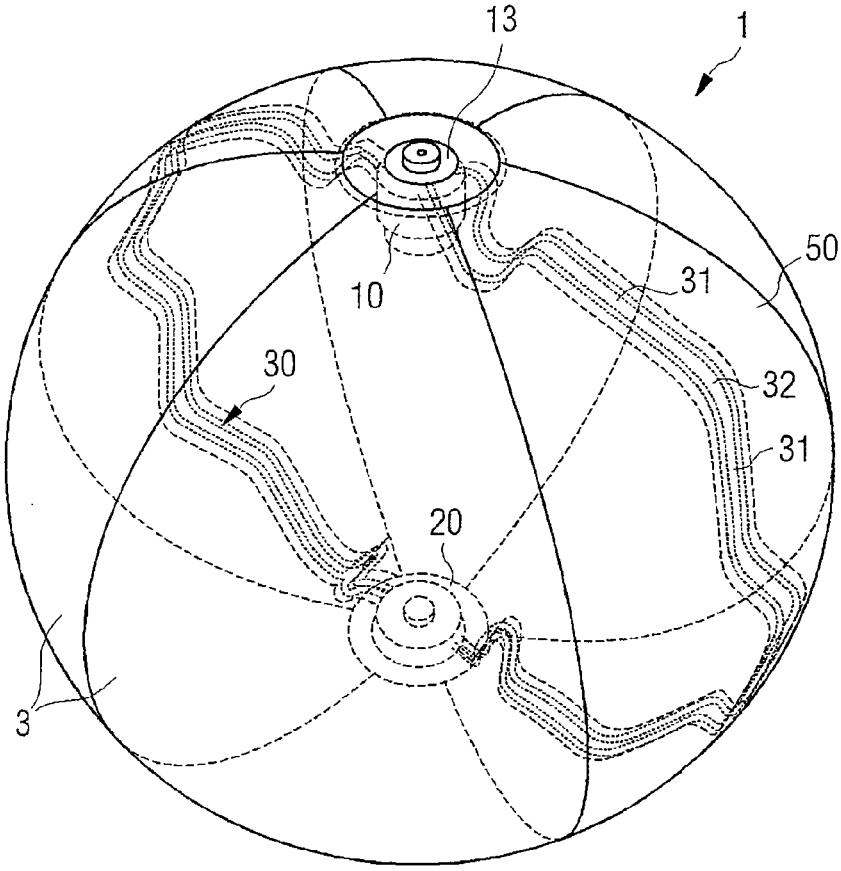
FIG. 1 is a general presentation of an exemplary embodiment of a bladder according to the invention.

FIG. 1 shows an embodiment of the bladder 1. The bladder 1 may be manufactured from a plastic material. As can be seen, the bladder 1 of the embodiment in FIG. 1 may have six segments 3 extending essentially from the top of the bladder 1, the "north pole", to the lower end of the bladder 1, the "south pole". The side edges of the segments 3 may be interconnected, for example by gluing or high frequency welding. Alternatively, the bladder 1 can also be produced in a different manner, for example by using fewer segments 3 or by means of an integral manufacture of the complete bladder wall 50 using extrusion or other methods. The bladder 1 can be produced from a vulcanized rubber material, as for example latex or from a plastic material, as for example thermoplastic polyurethane (TPU). Thereby it may be beneficial for the assembly if the bladder 1 is manufactured from a transparent or translucent material.

A valve 10 may be arranged at the north pole of the bladder 1. The valve 10 can have an indicator device 13 with two light emitting diodes, for example a green one and a red one, which indicate whether the air pressure inside the bladder 1 is within a predefined range (for a soccer ball, for example 0.8-1.0 bar). The red light emitting diode can be seen in FIG. 1, whereas the green light emitting diode is arranged on the other side of the valve 10 and therefore not shown in FIG. 1. An electronic component 20 may be arranged at the south pole of the bladder 1 including, for example, a pressure sensor and a power supply, for example a battery, which may be rechargeable.

It is to be noted that the light emitting diodes, the pressure sensor and the battery are only examples for the electrical and/or electronic components which can be arranged inside or at the bladder 1. Other electrical/electronic devices may alternatively or additionally be arranged in or at the bladder 1, such as e.g. accelerometers, speakers, GPS-receivers, transmitters and/or receivers of electromagnetic signals, acoustic and/or optical signal indicators, memory chips for storing data, for example acceleration values or position data or an induction coil for inductively charging or a charging socket for charging the energy storage, such as a battery or a capacitor, etc. The corresponding wiring may include a different number of cables than the number of cables explained in the following detailed description depending on how many components are to be interconnected.

Figure 3:
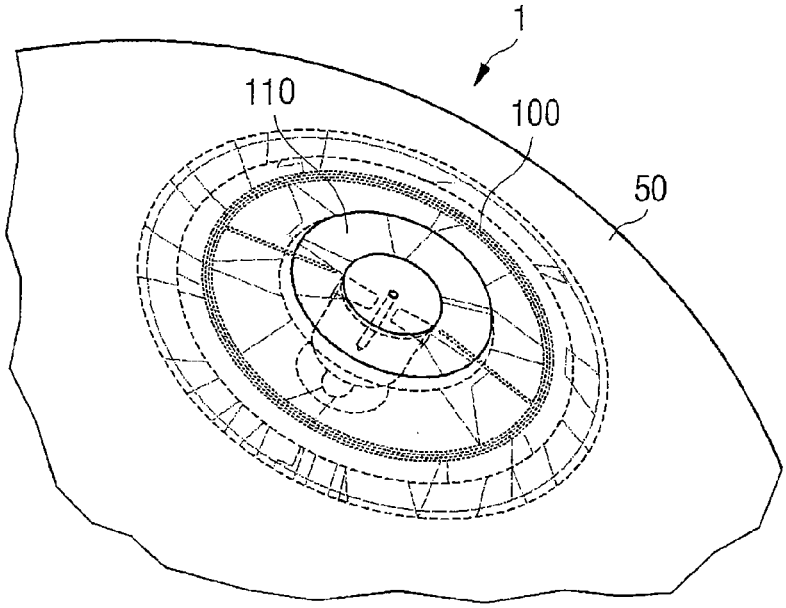
FIG. 3 is a schematic presentation of a further embodiment of the present invention.

FIG. 3 depicts schematically an example of an induction coil provided with the wiring according to the invention. A bladder 1 of a ball with a valve 110 and an electromagnetic coil 100 can be seen. The electromagnetic coil 100 may be attached to the bladder 1 and surrounds the valve 110 in a circular manner. In further embodiments the electromagnetic coil 100 may be arranged at other locations at the bladder 1, at which the proximity to the electromagnetic field plays a role. The closer the electromagnetic coil 100 is to the electromagnetic field of a charging station the faster the energy storage device connected to the electromagnetic coil can be charged, and the less energy is required.

As can be seen in FIG. 1, the electronic component 20 and the light emitting diodes may each be connected by means of a pair of cables 30. Depending on the pressure inside the bladder 1, one or the other light emitting diode is supplied with power each via a pair of cables 30. In the embodiment of the bladder 1 shown in FIG. 1, the two pairs of cables 30 may be arranged along opposite segments 3 of the outer bladder wall to avoid an imbalance of the bladder 1 and therefore the ball. This is not absolutely necessary in view of the small weight of the cable 30. For example in a simpler embodiment, the pressure indication may comprise only a single light emitting diode which is supplied by a single pair of cables 30 arranged only in a single segment 3. However, also in this case some embodiments of the bladder 1 may have the positive cable and the ground cable extend along opposite segments of the bladder wall 50 to avoid an unbalanced mass of the bladder 1. Conversely, it is also possible to arrange cables along more than two segments 3 of the outer bladder wall, for example if more than four electrical wires are needed for interconnecting two components or if a complex antenna configuration is to be realized.

The overall presentation in FIG. 1 shows an approximately zigzag-shaped course of the two cable pairs 30 along the bladder wall formed by alternating straight sections 31 and curved sections 32. Pulling loads of the cables 30 and therefore on the electrical connections at the light emitting diodes 13 and the device 20 are thus avoided, even if the bladder 1 is subjected to extreme deformations. Apart from the zigzag-shaped course shown in FIG. 1, other arrangements of straight and curved sections are also conceivable in order to achieve this objective.

Figure 4A:
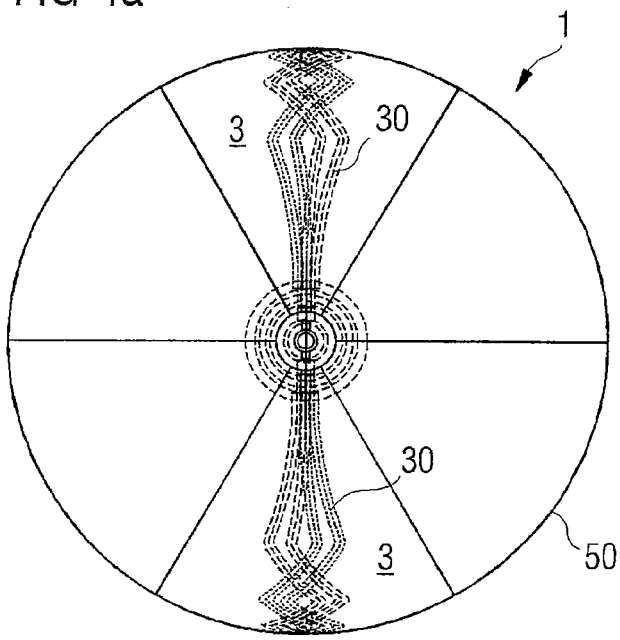
FIGS. 4*a*, 4*b* are a schematic top view and a schematic side view, respectively, of a further embodiment of the present invention.
Figure 4B:
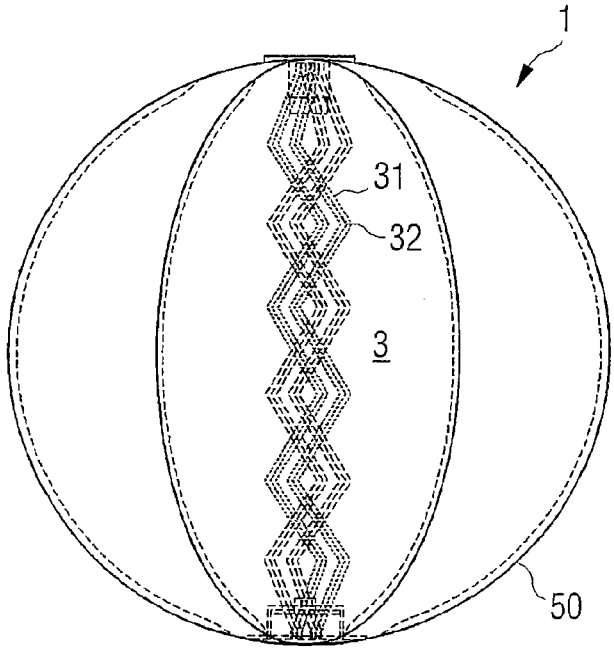

FIGS. 4*a* and 4*b* show further schematic representations of the zigzag-shaped course. Thereby a symmetrical arrangement of the wiring at opposite segments 3 of the bladder wall 50 can be seen. Furthermore, these representations show in still greater clarity the multitude of sections 31 which are connected with each other via curved sections 32 (cf. FIG. 4*b*).

In some embodiments, in particular for a soccer ball, an arrangement wherein the cables may not extend substantially following a geodesic line, i.e. the shortest connection along the bladder wall 50 between the electrical/electronic components to be connected is least preferred. In the bladder 1 of FIG. 1 where the light emitting diodes 13 are arranged at the north pole and the device 20 is arranged at the south pole a geodesic line is a cable course along a virtual "meridian" of the bladder 1. An arrangement along a geodesic line poses a greater risk that, when subjected to large deformations, the cable detaches from the bladder wall 50 and damages the electrical connections and/or the bladder wall 50. However, for balls which are subject to less strong deformations, this aspect may be less relevant so that it maybe useful to arrange in such a case the wiring along a geodesic line in order to save cable length and therefore weight.

Figure 2:
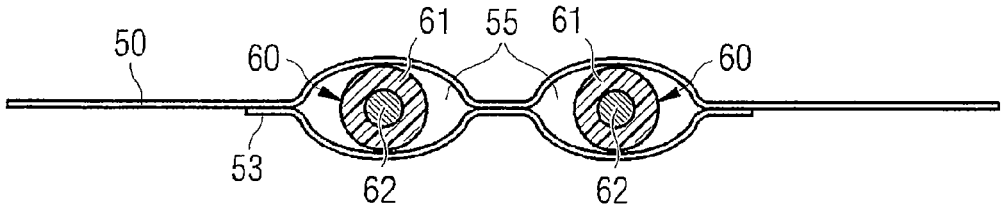
FIG. 2 is a symmetrical cross section of an exemplary outer bladder wall and the arranged wiring.

FIG. 2 shows schematically an exemplary arrangement of a cable pair 60 of the above explained embodiments extending along the bladder wall 50. To this end, a further material 53 may be laminated to the inner side of the bladder wall 50 so that two tunnels or channels 55 are formed wherein each cable 60 can extend in such a tunnel. It is also possible to arrange two or more cables 60 within a common tunnel 55 of the bladder wall 50. Tunnel(s) 55 may be advantageous when thin cables are used to avoid great corrugations on the surface of the bladder wall 50 which may lead to difficulties when interconnecting the bladder 1 to the carcass and/or the shell of the ball. Alternatively, the tunnel(s) 55 can also be arranged at the outside of the bladder wall 50 (not depicted). In the case of an arrangement at the inside of the bladder 1, in some embodiments the tunnel 55 may be partly formed by the bladder wall 50, or the tunnel 55 may be separately manufactured and subsequently fastened to the bladder wall 50.

The cables 60 may be flexibly arranged within the tunnel 55. To this end, each cable 60 may have at the end of the tunnel 55 an adequate additional length. Moreover, the zigzag-shaped course results in any case that the cables 60 have an adequate play so that even large deformations of the bladder 1 do not result in damage of the cable 60, its connections or of the bladder wall 50.

The tunnels 55 may provide on the one hand a secure anchoring of the cables 60 along the bladder wall 50. On the other hand they may also allow a certain play of the cables 60 so that pulling loads on the electrical connections may be avoided. In some embodiments, a plurality of holes are arranged on the side of the tunnels 55 directed to the interior of the bladder (not shown in the figures) to allow an equalization of the pressure and to avoid any loads on the material due to different pressures. The holes or openings may be arranged in the area of the curved sections 32 and thereby may also avoid a folding and delamination of the material 53 which forms the inner wall of the tunnels 55.

In the embodiment shown in FIG. 2, each cable 60 may have its own insulation layer 61 surrounding the actual conductor 62. However, if the conductor 62 is sufficiently thin, it can also be directly integrated into the bladder wall 50, for example during calendaring of a plastic foil which is used as bladder material. Further, embodiments are conceivable, wherein the cables 60 may be simply glued to the inside or the outside of the bladder wall 50 or connected to the bladder wall 50 by means of high frequency welding. Finally, it is also possible to connect certain sections of the cables 60 only to the bladder wall 50.

Also, the wiring depicted in FIG. 3 for the provision of an induction coil can similarly be arranged at the bladder wall 50. It is also conceivable to arrange several windings of the coil 100 within an essentially circular tunnel at the inside or outside of the bladder wall 50. It is also conceivable to provide several concentric tunnels in which in each case one or several coil windings are provided (not depicted).

What is claimed is:

1. A bladder for an inflatable ball, the bladder comprising:

a bladder wall having a shape substantially corresponding to a shape of the ball, wherein the bladder wall comprises an inner side facing a center of the ball shape, and an outer side facing opposite the inner side; and electrical wiring, wherein a length of the electrical wiring is at least partly arranged along the inner side of the bladder wall, wherein the wiring is at least partly arranged inside a tunnel extending along the bladder wall.

2. The bladder according to claim 1, wherein the wiring is coupled to the inner side of the bladder wall.

3. The bladder according to claim 1, wherein a length of the tunnel is at least partly formed by the inner side of the bladder wall.

4. The bladder according to claim 1, wherein the tunnel comprises a plurality of openings into the interior of the bladder.

5. The bladder according to claim 1, wherein the wiring along the bladder wall comprises substantially straight sections connected by a curved section.

6. The bladder according to claim 1, wherein the wiring comprises two sections which are relative to a center of the bladder arranged on substantially opposite segments of the bladder wall.

7. The bladder according to claim 1, wherein the wiring interconnects a first electrical or electronic device with a second electrical or electronic device.

8. The bladder according to claim 7, wherein the wiring interconnects a pressure sensor for measuring the pressure within the bladder with a display device.

9. The bladder according to claim 8, wherein the display device is integrated into a valve of the bladder.

10. The bladder according to claim 7, wherein the wiring interconnects an electromagnetic coil with an energy storing device.

11. A ball comprising:

a bladder comprising a bladder wall having a shape substantially corresponding to a shape of the ball, the bladder wall defining an interior cavity configured to contain air under pressure;

electrical wiring disposed within the interior cavity and at least partly arranged along a bladder wall;

a first electrical or electronic device connected to the electrical wiring; and a second electrical or electronic device, wherein the wiring interconnects the first electrical or electronic device with the second electrical or electronic device, wherein the first electrical or electronic device comprises a pressure sensor for measuring the pressure within the bladder and the second electrical or electronic device comprises a display device, and wherein the wiring is at least partly arranged inside a tunnel extending along the bladder wall.

12. The ball according to claim 11, wherein the wiring is coupled to an inner side of the bladder wall.

13. The ball according to claim 11, wherein the tunnel is at least partly formed by the bladder wall.

14. The ball according to claim 11, wherein the tunnel comprises a plurality of openings into the interior of the bladder.

15. The ball according to claim 11, wherein the wiring along the bladder wall comprises substantially straight sections connected by a curved section.

16. The ball according to claim 11, wherein the wiring comprises two sections which are relative to a center of the bladder arranged on substantially opposite segments of the bladder wall.

17. The ball according to claim 11, wherein the display device is integrated into a valve of the bladder.

18. A ball comprising:

a bladder defining an interior cavity configured to contain air under pressure; and an electrical wire disposed along a bladder wall within the interior cavity and coupled to the bladder at a first region of the bladder and a second region of the bladder, wherein the electrical wire is free from coupling to the bladder between the first region and the second region, wherein the length of the wire extending between the first region and the second region is greater than the geodesic distance between the first region and the second region along the bladder.

19. The ball according to claim 18, wherein the electrical wire extends between opposing poles of the ball.

20. The ball according to claim 19, wherein the electrical wire does not take the form of a geodesic line between the opposing poles.

21. A ball comprising:

a bladder defining an interior cavity configured to contain air under pressure;

an electrical wire disposed along a bladder wall within the interior cavity and coupled to the bladder at a first region of the bladder and a second region of the bladder, wherein the electrical wire is free from coupling to the bladder between the first region and the second region; and a tunnel formed between the bladder and a material disposed within the interior cavity and coupled to the bladder, wherein the wire extends through the tunnel and is coupled to the bladder thereby.

22. The bladder according to claim 1, wherein the wiring along the bladder wall comprises connected opposing curved sections.

* * * * *